United States Patent [19]

McKissack

[11] 4,052,919

[45] Oct. 11, 1977

[54] MOTOR-DRIVEN BOLSTER PLATE

[75] Inventor: Patrick G. McKissack, Gary, Ind.

[73] Assignee: The Anderson Company, Gary, Ind.

[21] Appl. No.: 723,433

[22] Filed: Sept. 15, 1976

[51] Int. Cl.[2] ..... B26D 7/24

[52] U.S. Cl. ..... 83/205; 83/221; 83/266; 83/563; 100/53; 100/229 R; 100/DIG. 18

[58] Field of Search ..... 83/266, 563, 562, 437, 83/205, 221, 399, 400; 72/419, 420, 446–448; 100/DIG. 18, 53, 224, 229 R

[56] References Cited

U.S. PATENT DOCUMENTS

| | | | |
|---|---|---|---|
| 3,818,748 | 6/1974 | Smit | 100/DIG. 18 |
| 3,878,773 | 4/1975 | Smit | 83/563 X |

*Primary Examiner*—J. M. Meister

*Attorney, Agent, or Firm*—Wegner, Stellman, McCord, Wiles & Wood

[57] ABSTRACT

A punch press having a bed, a reciprocable press ram carrying a die member, means for reciprocating the ram between raised and lowered positions, and a sliding bolster plate carrying another die member mounted for movement between a withdrawn load position and a retracted work position. The press includes a drive assembly for harmonically reciprocating the bolster plate, positioning sensors for disconnecting the drive assembly when the bolster plate reaches its load position or its work position, a positioning control mechanism for locking the bolster plate at its work position and triggering reciprocation of the press ram and an electrical operating and interlock circuit for controlling and ensuring proper operation of the press.

10 Claims, 6 Drawing Figures

MOTOR-DRIVEN BOLSTER PLATE

BACKGROUND OF THE INVENTION

1. Field of the Invention

This invention relates generally to a power punch press and, more particularly, to a motor-driven sliding bolster plate employed in conjunction with a power punch press including a bolster plate positioning mechanism and an electrical operating and interlock circuit.

2. Description of the Prior Art

In power punch presses, a sliding bolster plate is employed to move the lower section of a stamping die away from a position under the press ram which carries the upper mating section of the stamping die. In operation, an operator places a workpiece on the lower section of the die and depresses the actuating switches at the front of the press. The bolster plate slides into the press to a working position with the lower die section aligned under the press ram. The ram is operated to shape the workpiece by closing the die members together. Thereafter, the press ram is raised to separate the die members and the bolster plate is moved outwardly away from the press ram to a loading position permitting the operator to remove the finished workpiece and insert a new workpiece easily without reaching under the press ram. The cycle is then repeated.

The sliding bolster plate permits the operator to load a workpiece into the press without placing his hands between the die members thereby lessening the probability of injury to the operator should the press be operated mistakenly. The sliding bolster plate complies with the "no hands in the die" requirement of the Federal Occupational Safety and Health Act.

Conventionally, hydraulic, often pneumatic, cylinder-piston driven systems are utilized to reciprocate the bolster plate. In order to avoid rapid stops and starts of the bolster plate which would dislodge a workpiece from its correct position on the die, the bolster plate must be driven slowly which, as a result, reduces the efficiency and output of the press.

Ferris et al. U.S. Pat. No. 3,446,106 is illustrative of a punch press having a sliding bolster plate. Therein, the bolster plate is reciprocated by a hydraulic motor. When the bolster plate is moved to a work position, the press ram is reciprocated. Thereafter, the bolster plate is returned to a load position. While the press shown in Ferris et al generally has some of the conventional strutural features incorporated into the punch press of the present invention, it does have some obvious drawbacks and disadvantageous features. Two of these disadvantageous features are (1) a sliding bolster plate which cannot be driven quickly without jarring stops and starts and (2) a sliding bolster plate which is not locked into place before the press ram is operated. The former is undesirable because the output rate of the press must be reduced to ensure work product of high quality. The latter is clearly undesirable because severe injury can be inflicted to the operator if there is premature operation and because the relatively expensive die members can be damaged if they are misaligned when they are closed together.

SUMMARY OF THE INVENTION

It is the principal object of the invention to provide a sliding bolster plate for a power punch press in which a drive assembly moves the bolster plate in a relatively smooth manner and a positioning control mechanism secures the bolster plate in proper alignment prior to reciprocation of the press ram.

In accordance with the invention, a drive assembly for reciprocating the bolster plate provides harmonic motion that assures smooth acceleration from a starting position to the midpoint position at which maximum speed is reached and gradual deceleration to the end position. Herein, a motor rotatably drives a crank which, in turn, operates a connecting arm that moves the bolster plate into and out of the press. Sensors are utilized in connection with an electrical operating and interlock circuit for determining bolster plate position and effecting accurate locking of the sliding bolster plate under the press ram and preventing premature engagement of the press clutch. If an error occurs in the performance of the press, operation of the press immediately ceases to prevent injury to the operator and damage to the dies.

In an exemplary embodiment of the invention, a clutch/brake module is connected to the motor, the clutch effecting disengagement between the motor and the crank and the brake terminating crank rotation immediately upon command. Positioning switches are provided to sense when the bolster plate has reached a load or a work position. The switches appropriately energize the module to disengage the clutch and set the brake.

A pair of positioning control mechanisms are operative to lock the bolster plate in correct position and to trigger reciprocation of the press ram. The control mechanisms shown herein include a shot pin, a shot pin solenoid, and a pair of switches which are actuated by an actuator arm movable with the shot pin. The control mechanisms are fixed to the press so that when the bolster plate is moved to a work position, the shot pin solenoids are actuated by one of the positioning switches to extend the shot pins into openings provided in the bolster plate thereby locking the bolster plate in fixed position relative to the press. When the shot pins are fully extended, a switch is automatically actuated by the arm which triggers reciprocation of the press ram. After reciprocation of the ram, the shot pin solenoids are actuated to retract the shot pins from the bolster plate. When the shot pins are fully retracted, the arm automatically actuates a switch which triggers the drive assembly to release the brake and engage the clutch so as to withdraw the bolster plate and move it to its load position. Movement of the bolster plate is terminated when the other positioning switch is actuated to trigger the brake and clutch.

In a preferred embodiment of the invention, the output of the motor is constant at all speeds so that the transfer time for a die between load and work positions is inversely proportional to its weight. Use of a variable-speed motor provides cycle time adjustment for dies of different weights.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
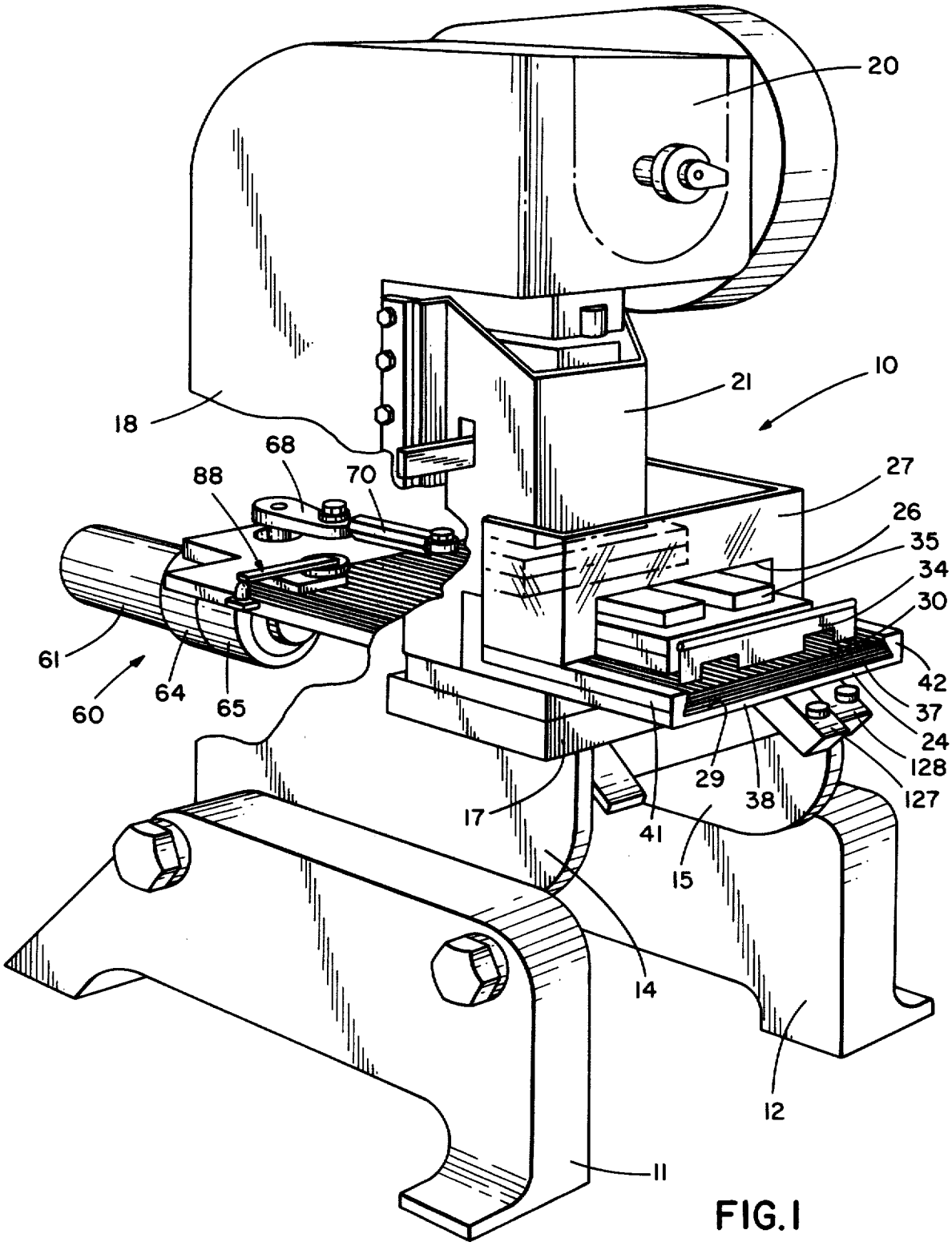
FIG. 1 is a perspective view of a power punch press constructed according to the invention having parts broken away to show the sliding bolster plate, the drive assembly and a portion of one of the positioning control mechanisms.

Referring to FIG. 1, a power punch press, generally designated 10, constructed according to the invention includes a lower frame portion having legs 11 and 12 and upper support members 14 and 15; a generally horizontal bed 17 spanning and secured to the support members 14 and 15; an upper frame portion 18; and a head 20 carried by the upper frame portion 18 including power means (not shown) operable to reciprocate a vertically movable press ram (not shown) which is enclosed within a press ram housing 21. As will be recognized by those skilled in the art, these components are conventionally incorporated into a punch press.

Secured to the top of the bed 17 is a generally horizontal platform plate 24 which extends inwardly into the press 10 through an opening 26 defined by a protective cage 27 and extends outwardly forward of the press 10. The cage 27 prevents accidental insertion of the operator's hands and arms, scrap material and the like. Movable along the top surface 29 of the platform plate 24 and parallel thereto is a sliding bolster plate 30. Mounted to the top 32 of the bolster plate 30 and moved therewith is a die holder 34 which, in turn, carries a stamping die member 35 which comprises the lower section of a pair of mating stamping die members. The upper section (not shown) of the stamping dies is carried at the lower end of the press ram.

The sliding bolster plate 30 is reciprocated between a rearward operative position (FIGS. 2 and 3) in which the lower die member 35 is in alignment with the overlying upper die member carried by the press ram and a forward inoperative position (FIG. 1) in which the forward edge 37 of the bolster plate 30 is withdrawn from the press 10 and aligned generally with the forward edge 38 of the platform plate 24. As is known, the press ram is reciprocated between a raised open position in which the die members 35 are spaced apart and a lowered closed position in which the die members 35 are engaged to suitably shape a workpiece disposed therebetween.

To guide the bolster plate 30 between its forward load position and its rearward work position, a pair of guide rails 41 and 42, having inwardly beveled undersurfaces, are secured on opposite lateral sides of the platform plate 24 by bolts 46 and 47, respectively. The bolster plate 30 has outwardly beveled edge surfaces which cooperate with the undersurfaces of the guide rails 41 and 42, respectively. Thus, the bolster plate 30 is permitted to reciprocate horizontally rearwardly and forwardly, but is prevented from being lifted vertically away from the top surface 29 of the platform plate 24.

Figure 2:
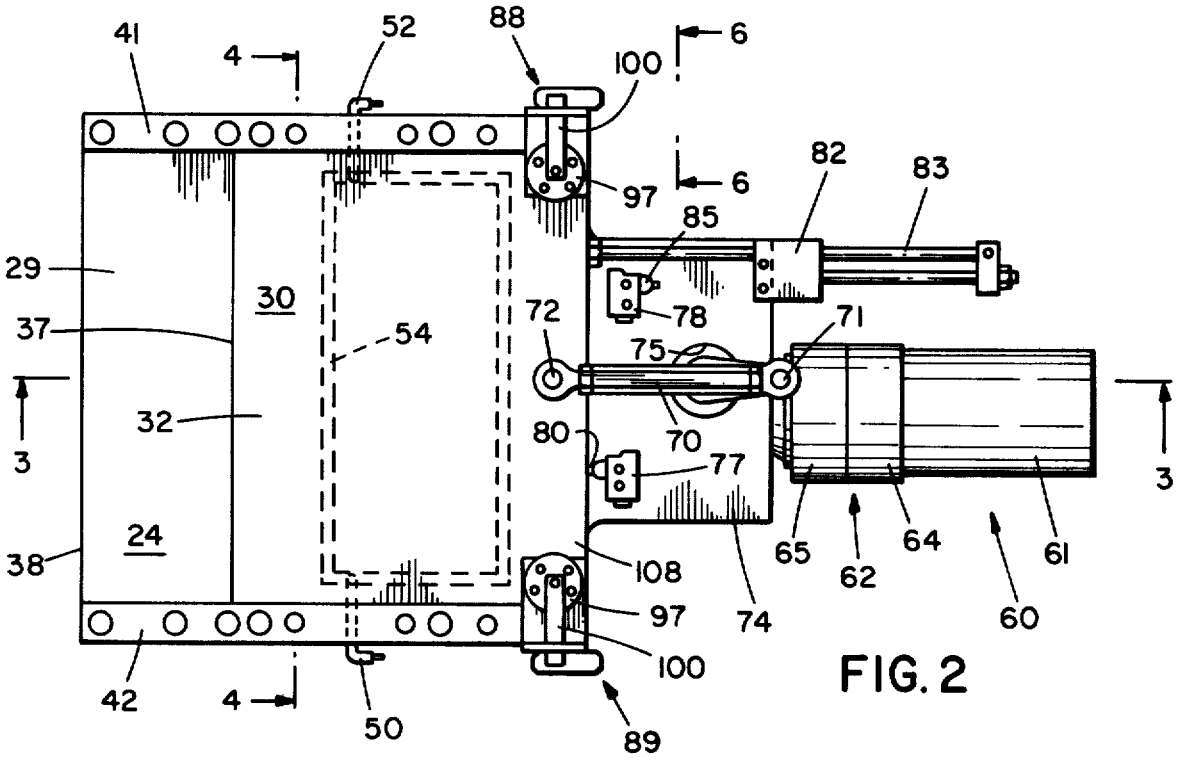
FIG. 2 is a horizontal view of the power punch press of FIG. 1 illustrating the arrangement of the sliding bolster plate, the drive assembly and the positioning control mechanisms.

In FIG. 2, a system for delivery of low-pressure compressed air to provide an air-bearing between the top surface 29 of the platform 24 and the bottom surface of the bolster plate 30 is seen to include inlet lines 50 and 52, and a channel 54 formed in the top surface 29 of the platform 24.

Figure 3:
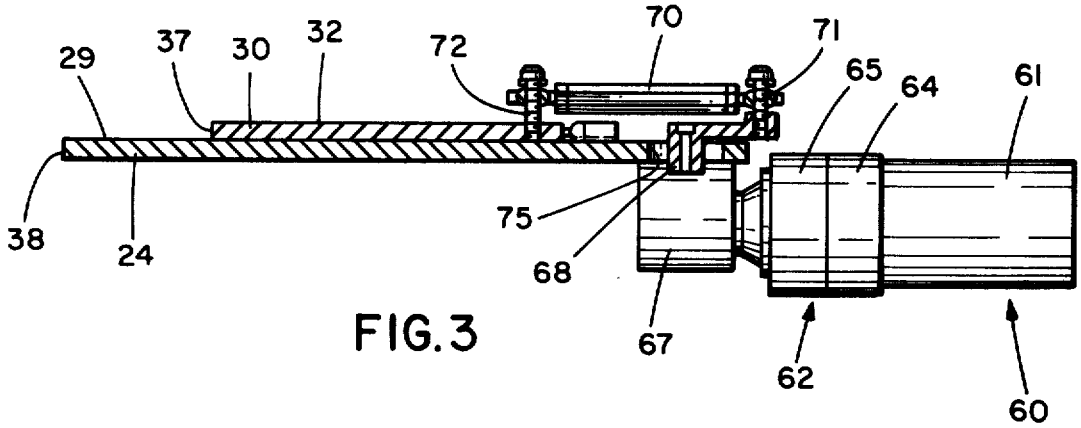
FIG. 3 is a vertical cross-sectional view of the power punch press taken along line 3—3 of FIG. 2 particularly illustrating the drive assembly.
Figure 4:
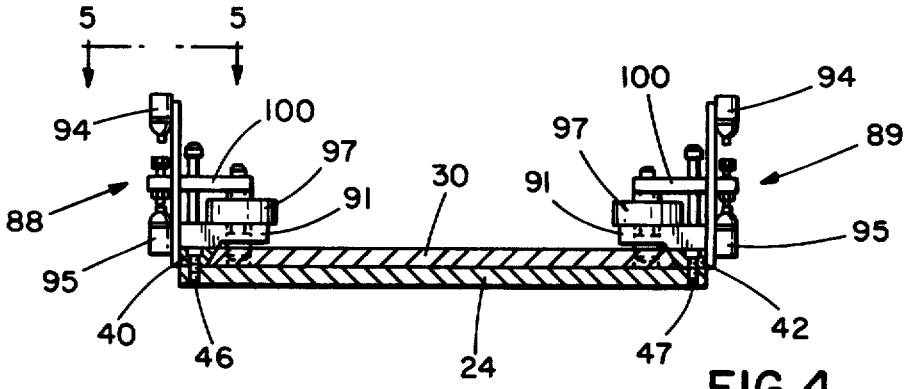
FIG. 4 is a vertical cross-sectional view of the power punch press taken along line 4—4 of FIG. 2 particularly illustrating the positioning control mechanisms.

The sliding bolster plate 30 is reciprocated by the operation of a drive assembly, generally designated 60. The drive assembly 60 includes a variable-speed, direct current electric motor 61, an electric clutch/brake module 62 consisting of a clutch 64 and a brake 65, a right-angle gear reducer 67, a Z-shaped crank 68 having one end coupled to the gear reducer 67, a connecting arm 70 pivotally connected to the other end of the crank 68 by a pin 71 and to the sliding bolster plate 30 by a pin 72. As seen in FIGS. 2 and 3, the platform plate 24 has a narrowed rearwardly-extending rectangular portion 74 underneath of which the housing of the gear reducer 67 is suitably secured. The crank 68 extends from the gear reducer 67 through an enlarged opening 75 formed in the rearward portion 74. The crank stem thus rotates circuitously in a horizontal plane above the platform plate 24 and the bolster plate 30. The motor 61 is run continuously, but the bolster plate 30 is moved only when the clutch/brake module 62 is energized so that the clutch 64 is engaged and the brake 65 released to operatively connect the gear reducer 67 with the motor 61.

It can be appreciated that as the crank 68 is rotated in either direction from the position of FIGS. 2 and 3, the rate of acceleration of the bolster plate 30 is small. When the crank 68 has rotated 90° from its starting position, maximum velocity of the bolster plate 30 is reached. When the crank 68 is eventually rotated to the position in FIG. 1 with the bolster plate 30 in its load position, the speed of the bolster plate 30 slows, deceleration being gradual. If rotation of the crank 68 continues, the bolster plate 30 is returned to its work position in a similar manner. The crank 68 and the connecting arm 70 define a translating connection between the motor 61 and the bolster plate 30 which converts constant radial motion into linear motion of varying velocity. The length of the crank 68 and the connecting arm 70 can be varied to change the rate and extent of movement achieved by the bolster plate 30 relative to the platform plate 24.

Positioning switches 77 and 78 are fixed to the top surface 29 of the rear portion 74 of the platform plate 24 to sense the position of the bolster plate 30 and appropriately deactivate the drive assembly 60. The switch button 80 of the switch 77 is depressed when the bolster plate 30 is moved to a rearward work position (FIGS. 2–3). An actuator 82 carried by an adjustable extension arm 83 which, in turn, is carried at the rear of the bolster plate 30 depresses the switch button 85 of the switch 78 when the bolster plate 30 is moved to its forward load position.

In order to assure correct longitudinal and lateral alignment of the bolster plate 30 before the press ram is actuated so as to prevent premature actuation, a pair of positioning control mechanisms, generally designated 88 and 89, are employed. The positioning control mechanism 88 is positioned rearwardly at one side of the platform plate 24 while the positioning control mechanism 89 is disposed at the opposite transverse side of the platform plate 24.

Since both positioning control mechanisms 88 and 89 are similarly constructed, for purposes of clarity and brevity, only control mechanism 88 will be described in detail.

Figure 5:
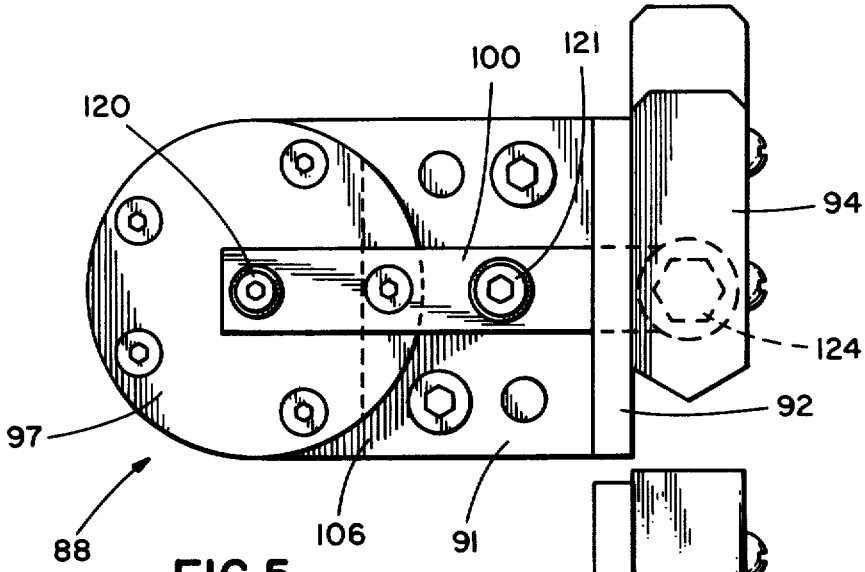
FIG. 5 is an enlarged top plan view taken along line 5—5 of FIG. 4 showing one of the positioning control mechanisms.
Figure 6:
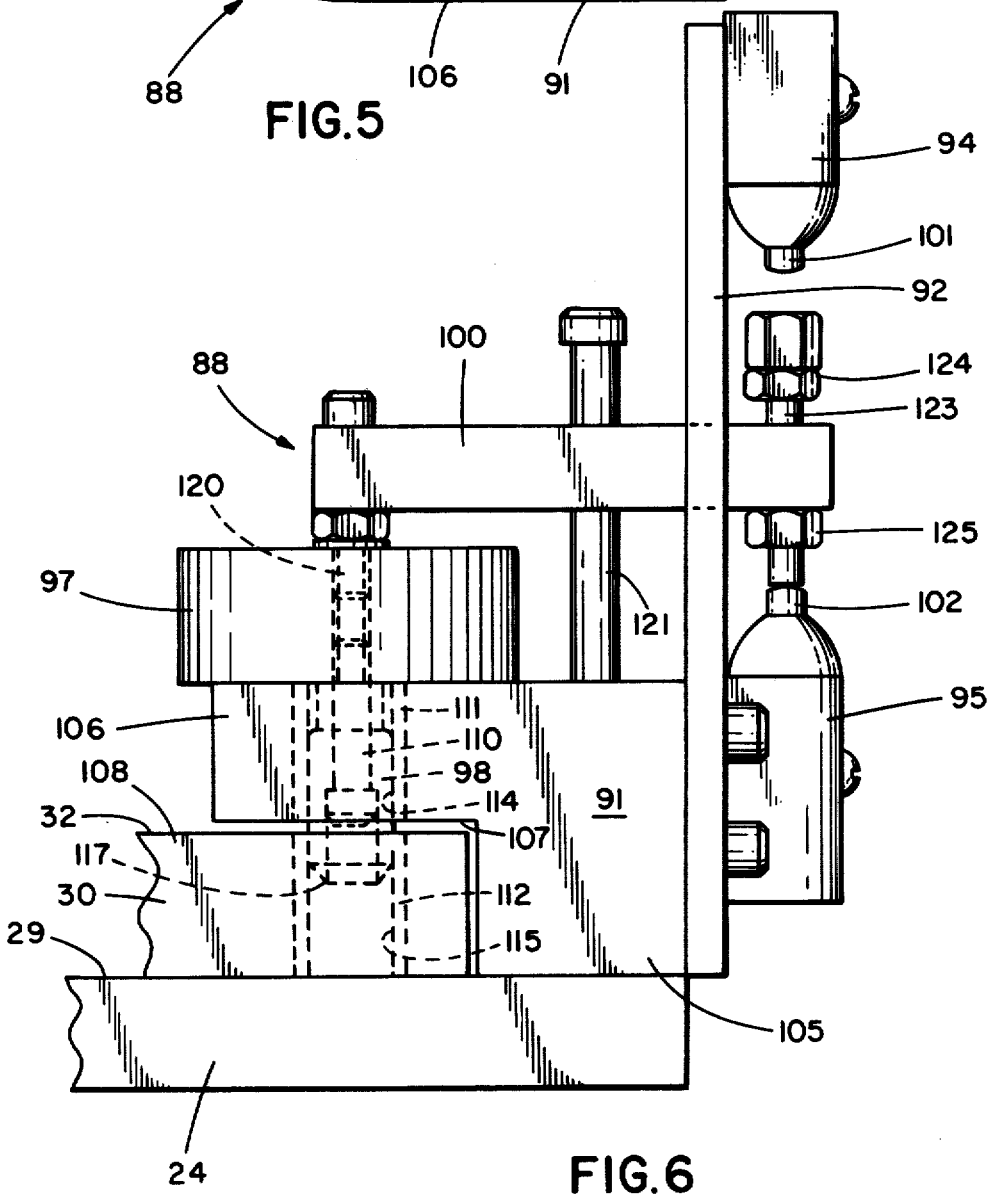
FIG. 6 is an enlarged rear elevational view taken along line 6—6 of FIG. 2 showing one of the positioning control mechanisms.

Referring to FIGS. 5 and 6, the positioning control mechanism 88 is seen to include an L-shaped holder 91 fixed to the platform plate 24, a switch bracket 92 mounted to and extending upwardly from the holder 91, a pair of switches 94 and 95 secured to the bracket 92, a shot pin solenoid 97 mounted on the top of the holder 91, a shot pin 98 operatively connected to the solenoid 97, and an actuator arm 100 also connected to the solenoid 97 and operative to selectively depress switch buttons 101 and 102 of the switches 94 and 95, respectively.

The holder 91 has a lower portion 105 fixed to the top surface 29 of the platform plate 24 and an upper portion 106 spaced above the platform plate 24 so as to permit the bolster plate 30 to slide thereunder. The guide rail 41 extends rearwardly and abuts the lower portion 105 of the holder 91. The bolster plate 30 has corner slots which define a narrowed, unbeveled rear portion 108 which fits between the cutout lower portions 107 of the spaced apart holders 91 so that it slides past and under the holders 91.

The shot pin 98 is secured to the shot pin solenoid mechanism 97 by a bolt 110. Bushings 111 and 112 have aligned openings 114 and 115 in the holder 91 and the bolster plate 30, respectively. The shot pin 98 can be inserted downwardly into the opening 115 in the bolster plate 30 to lock the bolster plate 30 against movement parallel to the bed 17. The beveled end 117 on the shot pin 98 will locate the bolster plate 30 correctly if it is near to, but not exactly at, its work position.

The actuator arm 100 has one end mounted to the solenoid mechanism 97 by a bolt 120 and is guided between extreme positions by an upright bolt 121 fixed to the holder 91. At the other end of the actuator arm 100 are adjustable contacts formed from a threaded shank or bolt 123 and nuts 124 and 125, which selectively depress the switch buttons 101 and 102. When the shot pin 98 is in a lowered operative position in which the lower end of the bolt 123 depresses the switch button 102, as seen in FIG. 6, the switch 95 is actuated so that the press ram is operated for one cycle. When the shot pin 98 is raised out of the opening 115 in the bolster plate 30, the upper end of the bolt 123 depresses the switch button 101 to operate the switch 94 which will actuate the drive assembly 60 to move the bolster plate 30.

When the bolster plate 30 is at its forward load position, the operator places a workpiece onto the lower die member 35 and depresses the operator switches 127 and 128 so that the brake 65 is released and the clutch 64 is engaged to drive the bolster plate 30 and the workpiece it carries toward a rearward work position. When the bolster plate 30 reaches its work position, the switch 77 is actuated to deenergize the clutch 64 and set the brake 65 to terminate movement of the bolster plate 30. Thereafter, the shot pin solenoids 97 are actuated so that the shot pins 98 are moved into engagement with the bolster plate 30 to align and lock the bolster plate 30 at its correct working position. When the shot pins 98 are in place, the actuator arms 100 will operate the switches 95 which, in turn, trigger the press ram so that it is lowered for engagement of the die members 35 for shaping the workpiece. When the press ram has returned to its raised position, a switch (not shown) is operated to actuate the shot pin solenoids 97 to retract the shot pins 98 from the bolster plate 30. When the shot pins 98 are withdrawn, the actuator arms 100 depress the switches 94 which effect release of the brake 65 and engagement of the clutch 64 to drive the bolster plate 30 and the workpiece it carries to its forward load position. When the bolster plate 30 is completely withdrawn from the press 10, the switch 78 is operative to cause disengagement of the clutch 64 and setting of the brake 65 so that movement of the bolster plate 30 is terminated. The operator removes the finished workpiece from the press 10 and replaces it with a new workpiece. The cycle is then repeated.

An electrical interlock circuit is employed in the invention to provide the above sequence of operations. The arrangement of the press is such that the functioning of one part is controlled by the functioning of another part. Since no part can normally be operated independently, the press herein provides a high level of safety for the operator.

I claim:

1. In a press including a supporting frame, a bed mounted on the frame, a bolster plate, a first die member carried by the bolster plate, means for mounting the bolster plate on the bed for sliding movement between a work position in the press and a withdrawn load position out of the press, a ram, a second die member carried by the ram, means for mounting the ram on the frame for movement between a raised open position and a lowered closed position, and means for reciprocating the ram between its raised and lowered positions, the press operating to move the ram to its lowered position with the second die member in engagement with the first die member when the bolster plate is positioned at its work position, the improvement comprising:

a drive assembly for reciprocating the bolster plate between its work and withdrawn positions, said drive assembly including a constant speed motor, a clutch, and a brake;

a crank having one end connected to said drive assembly so that the other end is rotated circuitously about said one end;

a connecting arm between the bolster plate and said other end of said crank; and a bolster plate positioning control mechanism including a reciprocable shot pin carried by the frame, means for reciprocating said shot pin, the bolster plate having an opening for receiving said shot pin, said opening being aligned with said shot pin when the bolster plate is at its work position, first switch means operated when the bolster plate is at its work position to activate said brake and disengage said clutch to end movement of said bolster plate, said switch means activating said shot pin reciprocating means to move said shot pin into said opening, second switch means operated when said shot pin is extended into said opening to actuate the ram reciprocating means to move the ram to its lowered position, third switch means operated when the ram is returned to its raised position to activate said shot pin reciprocating means to retract said shot pin from said opening, fourth switch means operated when said shot pin is retracted from said opening to deactivate said brake and engage said clutch so that said drive assembly operates to move said bolster plate to its load position and fifth switch means operated when the bolster plate is moved to its load position to activate said brake and disengage said clutch to terminate movement of said bolster plate.

2. In a press including a supporting frame, a bed mounted on the frame, a bolster plate, a first die member carried by the bolster plate, means for mounting the bolster plate on the bed for sliding movement between a work position in the press and a withdrawn load position out of the press, a ram, a second die member carried by the ram, means for mounting the ram on the frame for movement between a raised open position and a lowered closed position, and means for reciprocating the ram between its raised and lowered positions, the press operating to move the ram to its lowered position with the second die member in engagement with the first die member when the bolster plate is positioned at its work position, control means comprising:

drive means for reciprocating the bolster plate between its work and load positions, said drive means including a motor, a clutch and a brake operatively interconnected;

first sensing means for determining when the bolster plate is moved to its work position and being adapted to control operation of said clutch and said brake, whereby said first sensing means deenergizes said clutch and sets said brake to terminate movement of said bolster plate when said bolster plate is at its work position;

second sensing means for determining when the bolster plate is moved to its load position and being adapted to control operation of said clutch and said brake, whereby said second sensing means deenergizes said clutch and sets said brake to terminate movement of said bolster plate when said bolster plate is at its load position;

locking means for fixing the bolster plate against movement relative to the press and the ram, said locking means being actuated by said first sensing means when the bolster plate reaches its work position;

first switch means for triggering the ram reciprocating means when said locking means has fixed the bolster plate to the press;

means responsive to the operation of the ram for disengaging said locking means when the ram returns to its raised position; and second switch means for initiating withdrawal of the bolster plate from the press and being adapted to control operation of said clutch and said brake, whereby said second switch means releases said brake and engages said clutch to initiate movement of said bolster plate when said locking means is disengaged.

3. The control means of claim 2 wherein said locking means includes an extendible pin, a solenoid fixed relative to the bed operable to extend and retract said pin, an opening in the bolster plate adapted to receive said pin, said opening being aligned with said pin when the bolster plate is at its work position to permit insertion of said pin into said opening so as to secure the bolster plate in fixed position relative to the arm.

4. The control means of claim 3 wherein said first switch means includes an actuator movable between two extreme positions operatively connected to said solenoid, and first and second switches disposed at each of said extreme positions, one of said switches being operated by said actuator when said pin is extended into said opening, the other of said switches being operated by said actuator when said pin is retracted from said opening.

5. The control means of claim 4 wherein said first sensing means comprises a third switch fixed relative to the bed and being disposed to the rear of the bolster plate, the bolster plate contacting said third switch when the bolster plate is moved to its retracted work position, said third switch triggering engagement of said locking means.

6. The press of claim 2 wherein said drive means further includes a crank having one end operatively connected to said motor through said clutch and said brake so that the other end is rotated circuitously about said one end, and a connecting arm between the bolster plate and said other end of said crank.

7. In a press including a supporting frame, a bed mounted on the frame, a bolster plate, a first die member carried by the bolster plate, means for mounting the bolster plate on the bed for sliding movement between a work position in the press and a withdrawn load position out of the press, a ram, a second die member carried by the ram, means for mounting the ram on the frame for movement between a raised open position and a lowered closed position, and means for reciprocating the ram between its raised and lowered positions, the press operating to move the ram to its lowered position with the second die member in engagement with the first die member when the bolster plate is positioned at its work position, a drive assembly for reciprocating the bolster plate between its work and load positions comprising:

a motor;

a crank having one end operatively connected to said motor, the other end being rotated circuitous about said one end; and a connecting member providing a translating connection between bolster plate and said other end of said crank, said translating connection converting radial motion into linear motion to harmonically reciprocate the bolster plate whereby the bolster plate is smoothly accelerated from a stopped position to maximum velocity and smoothly decelerated from maximum velocity to a stopped position.

8. The drive assembly of claim 7 further including a clutch and brake module operatively connected between said motor and said crank, means for disengaging the clutch and activating the brake when the bolster plate is moved to its work or load position, and means for releasing the brake and engaging the clutch when the bolster plate is to be reciprocated, said motor being continuously operated so that driving torque is immediately delivered to the bolster plate when the brake is released.

9. The drive assembly of claim 8 further including a gear reducer operatively connected between said clutch and brake module and said crank for decreasing the angular velocity of said crank.

10. The drive assembly of claim 8 wherein said motor is a variable-speed direct current motor.

* * * * *